US007102540B2

(12) United States Patent
Runyon et al.

(10) Patent No.: US 7,102,540 B2
(45) Date of Patent: Sep. 5, 2006

(54) REMOTE ACCESS OF AN AIRPORT AIRFIELD LIGHTING SYSTEM

(75) Inventors: Edwin K. Runyon, Worthington, OH (US); Jess Murphy, Delaware, OH (US); Stephen Rauch, Pickerington, OH (US); Joe Pokoj, Westerville, OH (US); John C. Stutz, Blacklick, OH (US)

(73) Assignee: Siemens Airfield Solutions, Inc., Columbus, OH (US)

( * ) Notice: Subject to any disclaimer, the term of this patent is extended or adjusted under 35 U.S.C. 154(b) by 60 days.

(21) Appl. No.: 09/848,158

(22) Filed: May 3, 2001

(65) Prior Publication Data

US 2002/0163447 A1 Nov. 7, 2002

(51) Int. Cl.
*G08G 5/00* (2006.01)

(52) U.S. Cl. ..... 340/953; 315/130; 340/933; 340/947; 340/642

(58) Field of Classification Search ..... 340/953, 340/642; 315/130; 244/114 R; 705/1, 13, 705/22, 28; 700/53, 9, 90, 275, 286, 297, 700/277

See application file for complete search history.

(56) References Cited

U.S. PATENT DOCUMENTS

| | | | | | |
|---|---|---|---|---|---|
| 4,313,063 | A | | 1/1982 | McHerron | 307/135 |
| 4,449,073 | A | | 5/1984 | Mongoven et al. | 315/130 |
| 4,939,505 | A | | 7/1990 | Cappellini et al. | 340/642 |
| 4,951,046 | A | | 8/1990 | Lambert et al. | 340/953 |
| 5,243,340 | A | | 9/1993 | Norman et al. | 340/953 |
| 5,291,299 | A | | 3/1994 | Karna | 315/323 |
| 5,359,325 | A | | 10/1994 | Ford et al. | 340/953 |
| 5,426,429 | A | | 6/1995 | Norman et al. | 340/953 |
| 5,548,515 | A | | 8/1996 | Pilley et al. | 342/36 |
| 5,877,961 | A | * | 3/1999 | Moore | 705/1 |
| 5,969,642 | A | * | 10/1999 | Runyon et al. | 340/953 |
| 6,028,535 | A | | 2/2000 | Rizkin | 340/955 |
| 6,138,249 | A | * | 10/2000 | Nolet | 714/25 |
| 6,195,609 | B1 | | 2/2001 | Pilley et al. | 701/120 |
| 6,236,332 | B1 | * | 5/2001 | Conkright et al. | 340/870.01 |
| 6,725,106 | B1 | * | 4/2004 | Covington et al. | 700/82 |

FOREIGN PATENT DOCUMENTS

| | | |
|---|---|---|
| WO | WO 00/17984 | 3/2000 |
| WO | WO 00/62136 | 10/2000 |
| WO | WO 01/22177 | 3/2001 |

* cited by examiner

*Primary Examiner*—Brent A. Swarthout

(57) ABSTRACT

Remote monitor and control of an airfield lighting system. A processing system local to the airport is provided in communication with the airfield lighting system for monitor and control thereof, the airfield lighting system producing airfield information for processing by the local processing system. The local processing system connects to a global communication network such that the airfield information is accessed from a remote location disposed on the global communication network.

31 Claims, 9 Drawing Sheets

900

| Airport Code (903) | User (912) | Auth. Code (914) | Service Level (902) | Data Parameters (910) | | | | E-mail Address (904) | Pager No. (906) | Tel. No. (908) |
|---|---|---|---|---|---|---|---|---|---|---|
| | | | | CCR1 | CCR2 | CCRn | Dielectric1 (911) | | | |
| aaaa | Cust1 | a123 | 1 | ok | ok | failed | ok | Cust1@ mail.com | No.1 | No.3 |
| | Sales1 | 1b23 | | ok | ok | failed | ok | | | |
| | Repair1 | 123c | | 4.5 | 4.6 | -0.3 | 10e+8 | Repair1@ mail.com | No.2 | No.4 |
| xxxx | Cust1 | a123 | 2 | | | | | | | |
| | Sales1 | ..... | | | | | | | | |
| | Repair2 | ..... | | | | | | | | |
| bbbb | Cust2 | 987g | 4 | 4.5 | 4.6 | -0.3 | | | | |
| | ..... | ..... | | | | | | | | |

FIG. 9

REMOTE ACCESS OF AN AIRPORT AIRFIELD LIGHTING SYSTEM

BACKGROUND OF THE INVENTION

1. Technical Field of the Invention

This invention is related to airport airfield lighting systems, and more specifically, to systems which monitor such airfield lighting systems and remote access provided thereto via the Internet.

2. Background of the Art

The future of aviation is undergoing a massive technological change with the use of Global Positioning System (GPS) technology. This change not only affects large air carrier airports, but also the smaller general aviation airports located in remote areas or small towns. Higher levels of finding are also becoming more available for general aviation airports.

It is anticipated that changes in federal regulations under the FAA (Federal Aviation Administration) will stipulate that the FAA no longer buy and maintain the approach equipment. Equipment will be funded by the FAA, however, the equipment will need to be installed and maintained by local airport maintenance staff and/or out-sourced to a maintenance contractor for support. This change from a centralized federal program to a localized standalone operation presents a new problem for approach lighting systems for general aviation airports. Not only will the local airports be held responsible for the maintenance of the airfield lighting and related systems, but they will need to provide the support contracts. Furthermore, in those remote areas where technically-capable maintenance personnel may not be readily available, other means are needed to ensure that the airport has a safe and operational airfield lighting system.

What is needed is a system which provides local monitor and control of the general aviation airport airfield lighting system while also offering remote portal access to the local system by authorized users for periodic review of the system data which indicates the viability of the airport system. Furthermore, the local system needs an automatic notification feature for automatically notifying selected users when system faults occur. Still further, what is needed is a centralized general aviation monitoring system which connects to monitor a number of remote general aviation airport airfield systems, including runway and approach lighting systems, etc., such that authorized individuals can access the remote systems from anywhere, and at any time.

SUMMARY OF THE INVENTION

The present invention disclosed and claimed herein, in one aspect thereof, comprises remote monitor and control of an airfield lighting system. A processing system local to the airport is provided in communication with the airfield lighting system for monitor and control thereof, the airfield lighting system producing airfield information for processing by the local processing system. The local processing system connects to a global communication network such that the airfield lighting system information is accessed from a remote location disposed on the global communication network.

BRIEF DESCRIPTION OF THE DRAWINGS

For a more complete understanding of the present invention and the advantages thereof, reference is now made to the following description taken in conjunction with the accompanying drawings in which:

FIG. 9 illustrates a database structure, in accordance with a disclosed embodiment.

DETAILED DESCRIPTION OF THE INVENTION

The disclosed system architecture consists of several components combined to effect a system that monitors the status of airfield lighting equipment, and reports status and failure condition information to a central control center. The control center then utilizes this information to dispatch service personnel to the airfield for corrective action. The control center also provides historical and trending analysis for the airfield equipment being monitored for the client.

The disclosed system is not limited to airfield lighting systems, but can accommodate any airport systems, including fire alarm systems, security systems, etc. In those situations where general aviation airports have conventional remote monitoring systems already in place, the disclosed system is operable to provide redundant control and measurement capability of the existing data points, or even displacing the conventional system in its entirety. For example, the FAA (Federal Aviation Administration) purchases and provides airfield equipment, e.g., approach lighting systems (ALS) and precision approach path indicators (PAPIs) for some, but not all, aviation airports, and the FAA currently elects to support (i.e., maintain and monitor) such approach systems for those selected airports. Regional FAA offices throughout the U.S. provide oversight of the respective ALS and PAPI systems utilizing a remote maintenance monitor (RMM) system for monitoring selected parameters of the regional airports. The associated RMM hardware and software of the FAA system is expensive. Where such an FAA implementation exists, the disclosed system can provide either redundant monitor and control capability of the various data points with access from the various networked entities, as will be described in greater detail hereinbelow, or preferably displace the FAA system entirely with a more robust and cost effective solution. In the least, substantial improvements in remote accessibility can be provided for the RMM data points via a redundant implementation of the disclosed system.

Figure 1:
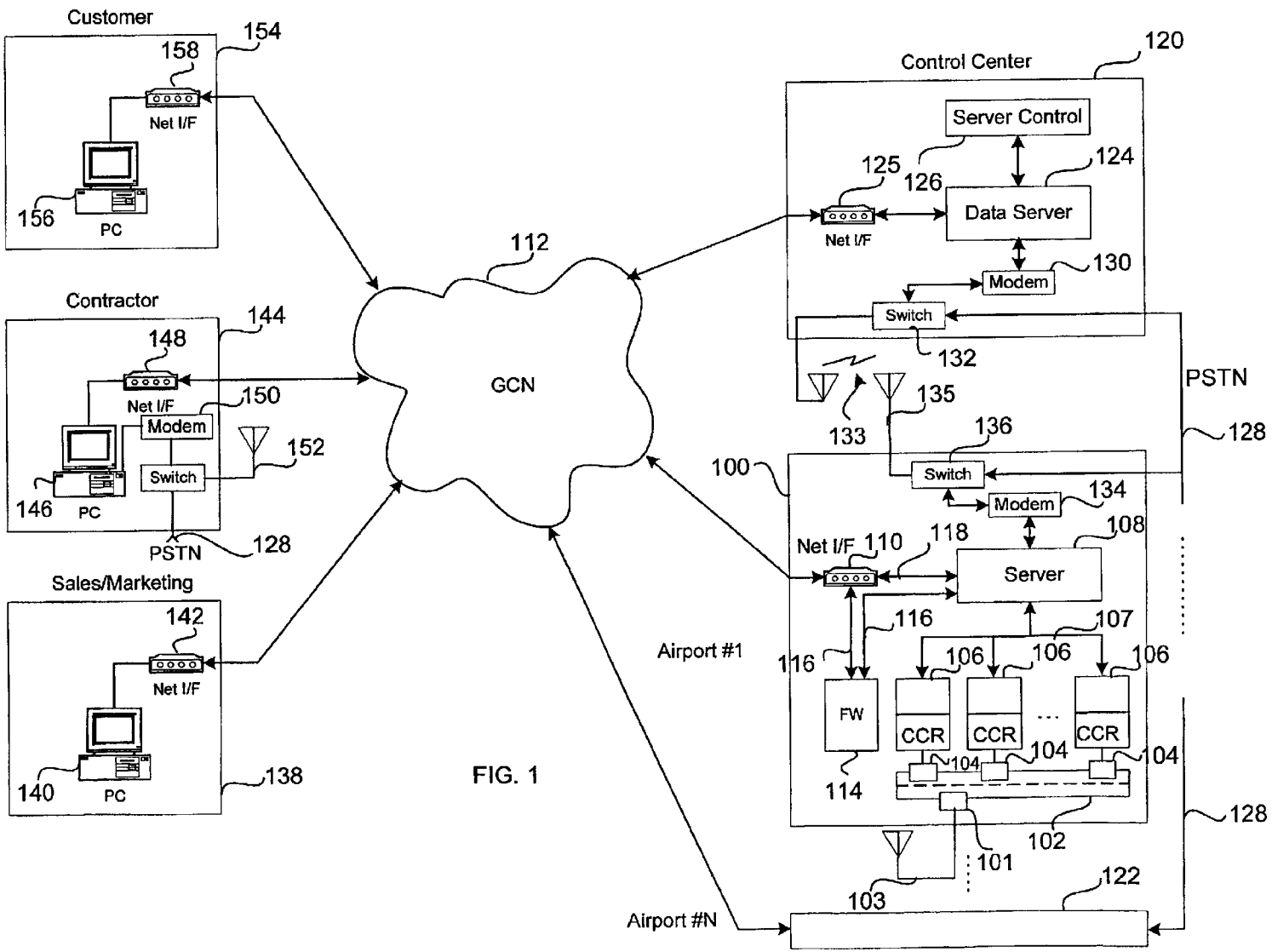
FIG. 1 illustrates a block diagram of a remotely accessible general aviation monitor and control system.

Referring now to FIG. 1, there is illustrated a block diagram of a remotely accessible general aviation monitor and control system, according to a disclosed embodiment. An airport 100 comprises a runway 102 which has associated therewith a number of airfield lighting system lights 104 whose electrical parameters are under control of a respective control and monitor unit 106. For example, the light interface control and monitor unit 106 may provide constant current control by way of a constant current regulator (CCR). Other means may be used to control each of the lights 104 of the runway such as voltage control devices. Note that the disclosed architecture is not restricted to runway lighting systems, but can be implemented to monitor and control any airport systems connect thereto. Examples include, as indicated hereinabove, ALS and PAPI systems, RMM systems, runway edge identifier lights, rotating beacons, etc.

The light interface units 106 each connect to a server 108 via a communication path 107 to facilitate the communication of monitor and control information to and from the light interface units 106, and to store data parameters related to the airfield lighting system of that particular airport 100. The communication network 107 between the control units 106 and the server 108 can be any conventional architecture which provides such connectivity. The medium can be optical fiber, metal wire, and even communication signals which are modulated onto power signals for transmission over power cables (e.g., X10 technology). The server 108 connects to an airport network interface device 110 for communication via an external global communication network (GCN) 112, e.g., the Internet, and offers access to the remote airport 100 from any node connected thereto. The airport network interface device 110 can be that which accommodates any technology for providing such communication capabilities, for example, DSL, cable modem access, ISDN, analog modem, T1, etc.

It can be appreciated that where global access is provided via the GCN 112, more secure measures may be needed to prevent unauthorized access to the server 108 and connected systems of the remote airport 100. For example, a firewall system 114 may be implemented to prevent such unauthorized access. The firewall system 114 connects to the airport network interface device 110 such that all incoming communication traffic is routed therethrough, and then to the server 108 along a path 116. Although the firewall system 114 is illustrated as a separate block, it can be consolidated into the server 108 such that all incoming traffic is routed directly from the airport network interface device 110 along a path 118 to the server 108. The firewall system 114 can also be apart of the airport network interface device 110, as can be obtained conventionally in conjunction with, for example, DSL modems, cable modems, ISDN modems/routers, etc.

For airport equipment which may be sited at locations too distant from the airport server 108 such that hard wire communication is impractical, a wireless communication technology may be implemented. For example, a piece of airfield lighting equipment 101 located at a remote airport location can be configured to accommodate a wireless transmitting device (not shown) which utilizes an antenna 103 for wirelessly uploading data to the airport server 108, and downloading information from the server, where desired. In this embodiment, radio frequency communication may be utilized.

A control center 120 disposed on the GCN 112 provides centralized control and monitor functions for the remote airport 100, and a plurality (2, . . . ,N) of remote airports 122. The control center 120 comprises a central data server 124 which stores all control and monitor data from the remote airports 100 and 122. The data server 124 interfaces to the GCN 112 via a network interface device 125, which network interface device 125 has capabilities similar to that disclosed in reference to network interface device 110 of the remote airport 100. The central data server 124 also connects to a server control block 126 which provides the control center user interface for the disclosed airport system, including database access of the central data server 124, application and data control for the remote server 108 of the airport 100 through the GCN 112 (and other alternative communication methods disclosed hereinbelow), and remote servers (not shown) of the remote airports 122.

Communication with the remote airports 100 and 122 is accomplished utilizing a number of methods. As indicated hereinabove, the control center 120 communicates with the remote airports 100 and 122 via the packet-switched GCN 112, or in instances where the GCN 112 may be inoperative, through a circuit-switched Public Switched Telephone Network (PSTN) 128. A modem 130 provides the interface for communicating over the PSTN 128, and using a switching device 132, alternatively facilitates communication over a wireless path 133, e.g., a cell phone, should the PSTN 128 become inaccessible.

The remote airport 100 has a compatible modem 134 and switching device 136 for utilizing either the PSTN 128 or the wireless path 133, if the GCN 112 becomes inaccessible. These various methods of maintaining communication with the airports 100 and 122 offer a variety of ways in which to maintain communication between the control central 120 in order to provide control parameters to airport server 108 and data parameters to the subscriber and maintenance contractor under many communication failure conditions. It can be appreciated that communication with the local maintenance contractor may also be accomplished directly from the airport server system 108 through the PSTN 128, or the GCN 112, or wireless path 133, in contrast to the notification coming indirectly from the remote airport through the control center 120. In this scenario, the fault notifications are stored in the remote server 108 and eventually transmitted to the data server 124 of the control center 120 for archiving and processing, and provided to the subscriber in accordance with the subscribed level of service.

Other nodes can access the remote airport 100 in accordance with various functions. For example, a sales/marketing node 138 has one or more computers 140 operatively connected to the GCN 112 through a sales network interface 142. The control center 120 hosts a website which is accessible by any node on the GCN 112. However, access to contents of the website is restricted to authorized users by use of a unique password or access code issued to each user. The sales/marketing node 138 is provided access to the website to facilitate illustration of the novel system to potential customers. Note that there may also be a plurality of such sales/marketing nodes 138 disposed on the GCN 112 which are provided access to the airfield lighting systems of the one or more remote airports (100 and 122).

A contractor node 144 for maintenance personnel who contract to provide support to the remote airport 120 may also be disposed on the GCN 112 to access the website provided by the control center 120. The contractor node 144 comprises a computer 146 (or other conventional network user interface device) which can access data associated with the remote airport airfield system to determine the status of the airfield lighting system, a contractor network interface device 148 for interfacing to the GCN 112 to facilitate accessing the website provided by the control center 120, and optionally a modem 150 can be provided as a backup means to the GCN 112 communication path for accessing the airport 100 via the PSTN 128. It can be appreciated that the contractor node 144 may also comprise a wireless solution 152 (e.g., cellular telephone) to facilitate wireless communication directly with the airport system 108 via the wireless path 133 if communication to the website is inaccessible via the GCN 112. However, the primary communication path is via the GCN 112 to the central control center 120.

A customer node 154 also disposed on the GCN 112 is provided access to the data via the website hosted by the control center 120. The customer node 154 utilizes a customer computer 156 (or other network user interface device) which communicates to the control center website through a conventional customer network interface device 156 across the GCN 112.

The central control center 120 also includes a network access security system to preclude unauthorized access thereto form the various communication paths which provide access thereto. For example, a firewall system is implemented where access via the GCN 112 is provided. Where dial-up access is provided, various security measures can be utilized, e.g., automatic call-back, user ID/password, etc. Where packet-switched networks are provided (e.g., intranets and extranets), access can be restricted to the unique network interface card ID of the authorized user.

Figure 2:
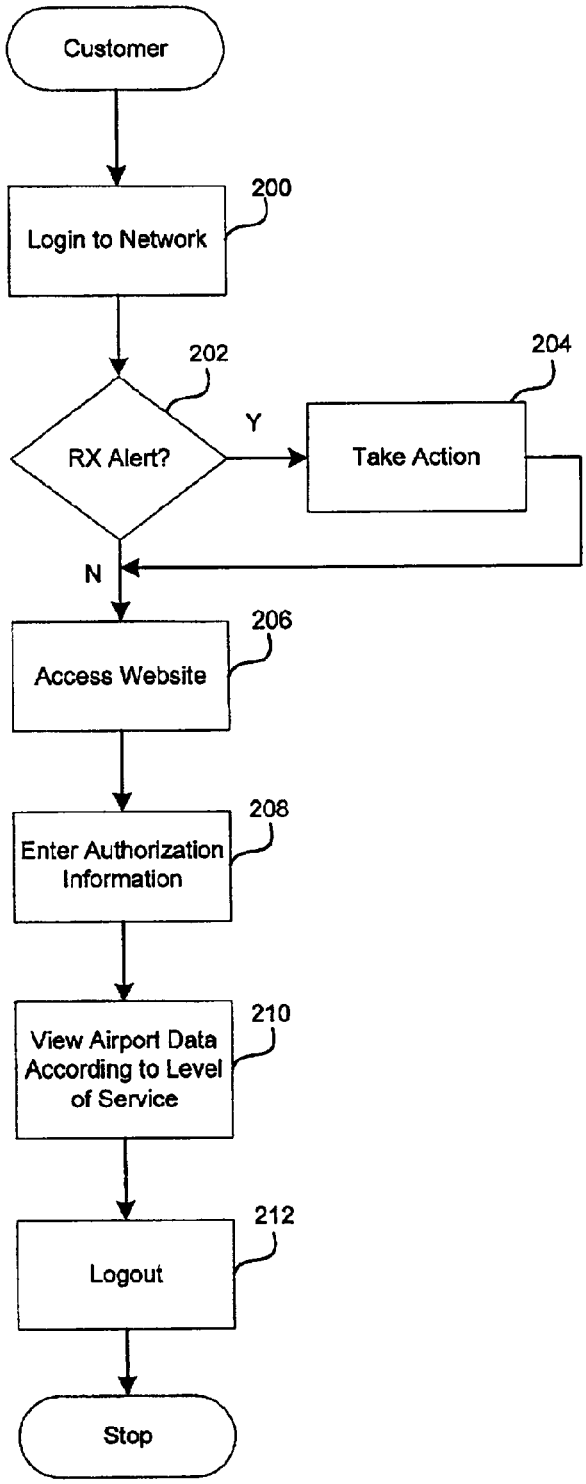
FIG. 2 illustrates a flow chart from the perspective of a customer/client when accessing the disclosed system.

Referring now to FIG. 2, there is illustrated a flow chart from the perspective of a customer/client when accessing the disclosed system. When the client subscribes to the disclosed airport system, they are issued at the time of subscription (or prompted to generate at a later time when first accessing the website) an authorization code for future use in logging in to the website in order to access the airport data points. Flow begins at a function block 200 where the client logs in to, e.g., a mail server (either local or remote mail server) which provides e-mail access to any node on the GCN 112. Flow is then to a decision block 202 to determine if any faults detected at the remote airport have caused email messages to be generated. (Note that notification is not restricted to e-mail messaging, but can be by any number of communication mechanisms, as indicated hereinbelow.) These e-mail messages can be transmitted to both the client and the maintenance support personnel in order to keep the client informed of any faults detected by the remote airport system. The message, in whatever format, can also be generated for delivery at a time when transmission costs are more favorable. For example, where telephone switched-circuit technology is used, there exist times when the cost of making such a transmission are less. Of course, the decision to delay such a notification is based upon several factors, for example, the type of failure, such that a nominal failure of a single light may result in the notification being delayed, while a total failure of the all systems causes immediate notification to occur. If an alert was transmitted to the client e-mail address, flow is out the "Y" path to a function block 204 to take action based upon the alert. The action could include automatically connecting the client node to the website provided by the control center 120 such the client can quickly log in and view the alert and its associated fault, as indicated by the output of function block 204 flowing to a function block 206. If no e-mail message was received, flow is out the "N" path to a function block 206 where the client accesses the website web page. Flow is then to a function block 208 where the client must enter authorization information in order to gain access to further data related to the remote airport 100. The client can then view the airport data in accordance with the level of service subscribed during the subscription period, as indicated in a function block 210. Note that the disclosed system need not have a level-of-service program such that the client is provided with total access to all information related to the remote airport 100. Flow is to a function block 212 where the client then logs out of the website, and the process reaches a Stop point.

Figure 3:
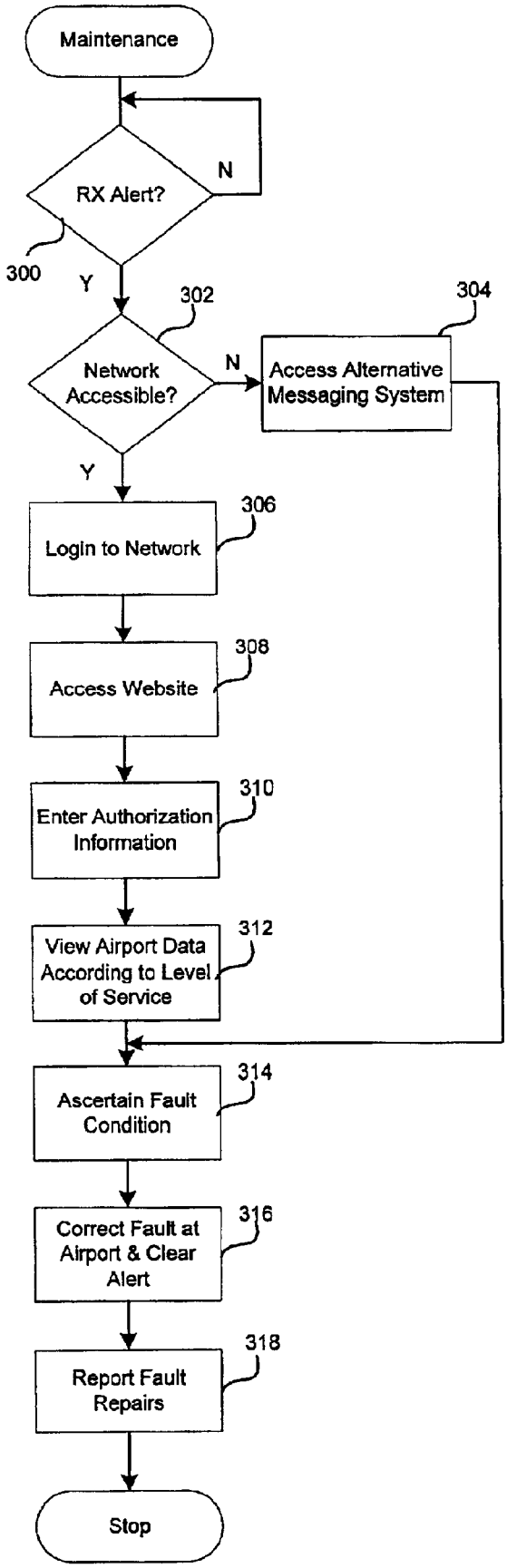
FIG. 3 illustrates a flow chart from the perspective of maintenance support personnel when accessing the disclosed system.

Referring now to FIG. 3, there is illustrated a flow chart from the perspective of maintenance support personnel when accessing the disclosed system. Flow begins at a decision block 300 where the alert notification monitor system at the maintenance support node 144 continually operates to check for a received alert. The alert notification system includes e-mail, facsimile, a pager, notification via a cellular telephone, etc. If an alert has not been detected, flow is out the "N" path and loops back to the input to continue monitoring for a received alert. If an alert has been received, flow is out the "Y" path to another decision block 302 to determine if the GCN 112 is accessible such that the maintenance personnel can access the remote airport 100 via the website provided by the control center 120 in order to obtain further information of the fault condition. It can be appreciated that this accessing step need not be performed prior to the maintenance personnel being dispatched to the remote airport 100 to correct the fault. However, this feature allows the maintenance staff to better prepare for correcting the fault condition, if it is of a kind which requires expensive replacement parts which may not be stored at the remote airport, or perhaps requires special test equipment in order to troubleshoot and resolve such a fault condition. If the GCN 112 is not accessible, flow is out the "N" path to a function block 304 where the support personnel at the contractor node 144 can use an alternative communication system to obtain more detailed information related to the type of fault condition. For example, a circuit-switched direct-dial connection may be implemented such that the contractor node 144 can communicate directly with the control center data server 124 through the contractor modem 150 via the PSTN 128. If a cell phone is used to contact the control center 120, communication can be through the wireless path 133 using air protocols (WAP—Wireless Application Protocol, and Wireless Java) to the control center modem 130. For example, where the cell phone has a display capability, the contractor can access the control center website using the cell phone such that web clipping can provide a reduced HTML (or other web page development language) visual or text presentation to the contractor regarding the particular fault condition, as indicated in a function block 314. Alternatively, support personnel at the contractor node 144 can communicate directly with remote airport server 108 via the wireless path 133 established between the contractor node antenna 152 and the remote airport antenna 135. These and other wireless Internet technologies accommodate the wireless transmission of Internet information according to handset geolocation information. (Note that alternative wireless mobile technologies include fixed wireless, broadband wireless (e.g., LMDS—Local Multipoint Distribution System, and MMDS—Multipoint Multichannel Distribution System) and satellite.) Other methods of communication connectivity can be implemented, for example, an intranet or extranet implementation.

Flow continues to a function block 316 where the maintenance personnel are dispatched to the remote airport 100 to correct the fault condition and clear the alert signal. Flow continues to a function block 318 where the support personnel then log the fault information and the repairs performed by entering this information into the airport server 108. The airport server 108 will then upload this information during the next programmed upload cycle. Notably, this repair information may also be entered directly to the control center server 124 via the control center website, where the repair technician logs in to the control center website using any available node in communication therewith, and enters the repair information into a predetermined repair form for archiving. What is important is that this repair information is ultimately archived in the control center server 124 for historical trending related to airfield parts and equipment which have failed. Note that the database of repair information can also be used for inventory control purposes, as discussed in greater detail with respect to FIG. 9. In accordance with the level of service provided to a subscribing customer, this trending information may also be made available to the customer who logs in via the control center website.

Referring again to decision block 302, if the GCN 112 is accessible, flow is out the "Y" path to a function block 306 where the repair technician logs in to the local system at the contractor node 144. Flow continues to a function block 308 where the technician accesses the control center website in order to obtain further information about the fault condition. The technician is then prompted for the authorization information, as indicated in a function block 310, in order to gain access to data related to the fault at the remote airport 100. The technician is then provided the fault information in accordance with the subscribed level of service, as indicated in a function block 312. In an alternative implementation, the e-mail message provides a hyperlink directly to the control center website, or in lieu thereof, provides a detailed description of the fault condition such that the technician is not further required to log in to the control center website to obtain more detailed fault information. In such an implementation, the e-mail message can be generated to automatically provide all of the fault information needed to properly address the fault condition. As part of generating the e-mail message, the control center data server 124 is automatically accessed to retrieve fault data sufficient to provide the technician the information necessary in correcting the fault condition. This email function can operate in lieu of, or in conjunction with the notification mechanism discussed hereinabove with respect to function block 314. Flow is then to the function block 316 where the technician reports to the remote airport 100 to make repairs and clear the alert. After making repairs, and in order to track failure history, the technician logs the repair information, as indicated in the function block 318. The maintenance process flow then reaches a Stop block.

Figure 4:
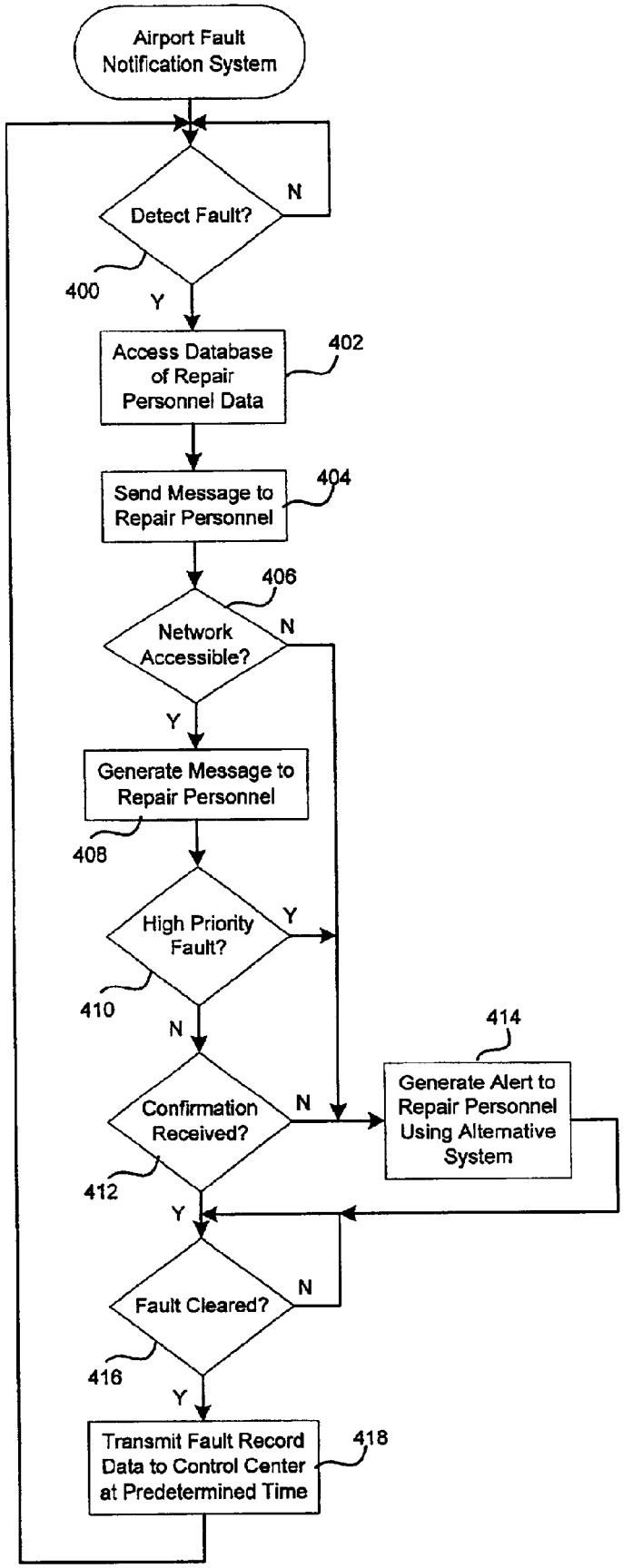
FIG. 4 illustrates a flow chart of the operation of the airport notification system, according to a disclosed embodiment.

Referring now to FIG. 4, there is illustrated a flow chart of the operation of the airport notification system, according to a disclosed embodiment. Flow begins at a decision block 400 where the fault notification system of the control center 120 processes recently-uploaded data from the remote airport server 108. If the data indicates that all parameters are within predefined limits, flow is out the "N" path, and loops back to the input to continue monitoring the data. If the data indicates that one or more monitored parameters are out of limits, the corresponding faults are noted. When a fault is detected, the control center system then accesses a database of the data server 124, which database may be the same database which includes the measured parameters of the remote airport 100, and retrieves maintenance personnel information associated with the particular remote airport 122 reporting the fault, as indicated in a function block 402. Additional airport system information may be retrieved at this time in anticipation that some or all of this information will eventually be forwarded to the repair technician as part of the notification alert, or perhaps in response to a later query by the technician for more detailed fault information. Flow is then to a function block 404 where the alert message is generated and transmitted to the repair technician. As mentioned hereinabove, any number of communication methods can be utilized to signal the repair technician at the contractor node 144, including but not limited to, transmission by e-mail via the GCN 112, a pager, cellular phone, personal data assistant, conventional telephone messaging, voice over IP (VoIP), etc. Flow is to a decision block 406 to determine of the GCN 112 is accessible. If not, flow is out the "N" path to utilize any one or more of the abovementioned communication methods to alert the technician to the fault condition at the corresponding airport, as indicated in a function block 414. Flow then continues to decision block 416 to determine if the repair technician has corrected the fault condition and cleared the alert. If not, flow is out the "N" path to the input of decision block 416 to continue monitoring the condition until the alert is cleared. If the repair technician has repaired the fault and cleared the alert, flow is out the "Y" path of decision block 416 to a function block 418 where, after the technician has logged all information related to the fault and correction thereof, the control center 120 uploads data from the remote airport server 108 at a predetermined time. This data is then accessible to any authorized user via the control center website. Flow then loops back to the input of decision block 400 to continue monitoring all remote airport servers 108 (and servers of the corresponding plurality of airports 122) for transmitted fault information.

Referring again to decision block 406, if the GCN 112 is accessible, flow is out the "Y" path to a function block 408 where a message is generated and transmitted (e.g., an e-mail message) to the repair technician at the contractor node 144. Note that alert notification by e-mail messaging may provide a sufficient response time for many fault conditions. However, in those instances where more catastrophic failures occur, for example, all airfield lights fail, the fault condition may need to be tagged in accordance with a priority hierarchy. Such a catastrophic failure will then be tagged a high priority failure, in which case e-mail messaging could be utilized in conjunction with one or more other alert notification methods disclosed hereinabove, or a more immediate notification method, such a paging the repair technician, could be used in lieu thereof. Therefore, if the fault condition is considered a higher priority fault condition, flow is out the "Y" path of decision block 410 to function block 414 to use an alternate communication method in order to facilitate faster response by the repair technician. Flow from this point follows the discussion detailed hereinabove. If the fault condition is deemed to not be of a high priority, flow is out the "N" path of decision block 410 to a decision block 412 to determine if a confirmation has been received. This can be an optional step to ensure that the repair technician has acknowledged receipt of the alert e-mail message. If not, flow is out the "N" path to function block 414 to use an alternative communication method of notifying the repair technician, and flow therefrom follows the discussion detailed hereinabove. If an e-mail confirmation was received, indicating that the repair technician acknowledged receipt of the e-mail alert, flow is out the "Y" path of decision block 412 to decision block 416 to determine if the repair technician has cleared the fault condition (i.e., reset the alert flag by repairing the fault condition). Discussion of subsequent branch conditions and steps follows that which was disclosed hereinabove with respect to decision block 416.

Figure 5:
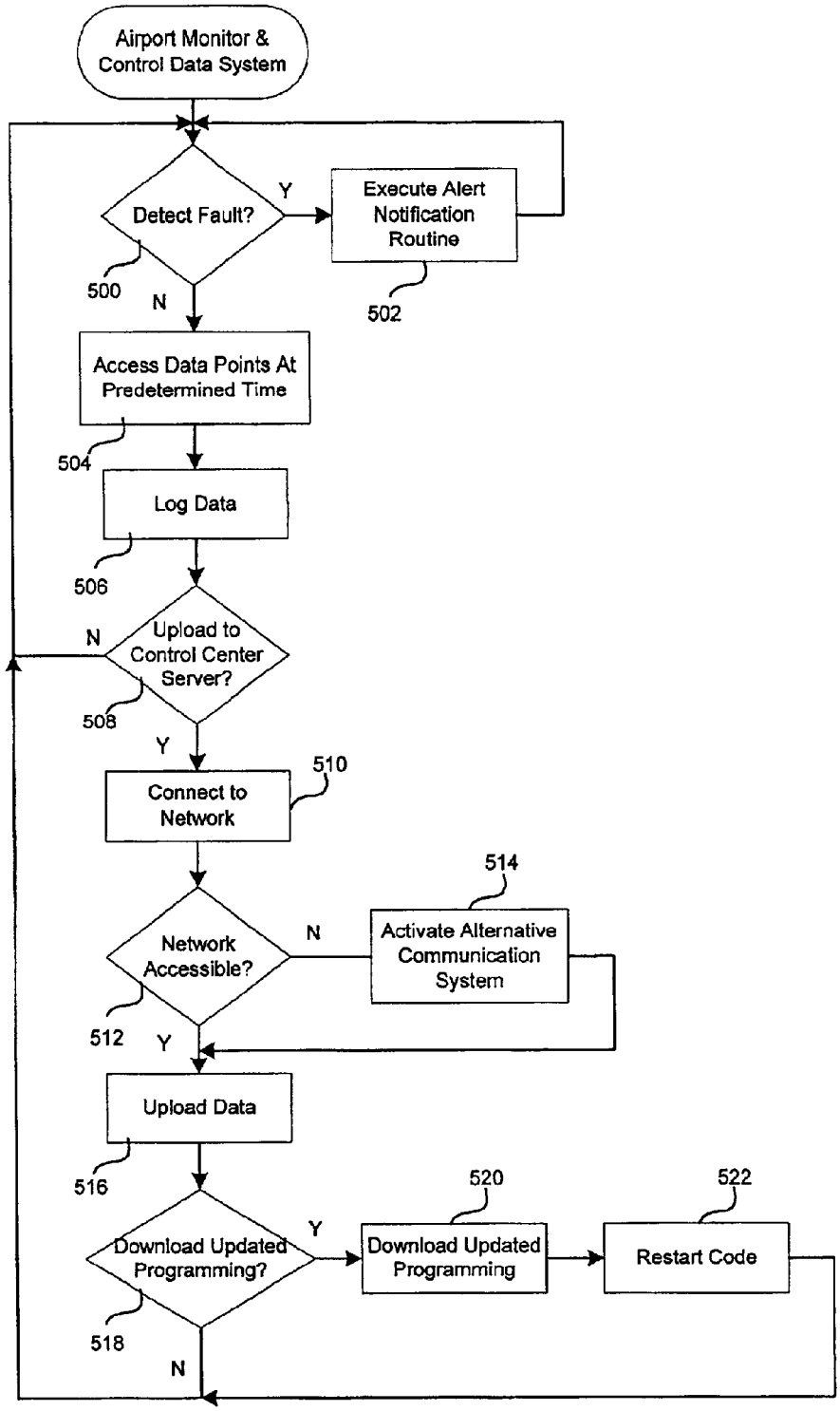
FIG. 5 illustrates a flow chart of the operation of the remote airport monitor and control system.

Referring now to FIG. 5, there is illustrated a flow chart of the operation of the remote airport monitor and control system. Flow begins at a decision block 500 to determine if a fault condition at the remote airport has occurred, and been detected. If so, flow is out the "Y" path to a function block 502 to generate an alert message in accordance with programmed notification parameters, which includes extracting data from the airport database server 108 in order to identify and notify the corresponding repair technician of the particular fault condition. Note that there can be more than one contractor supporting the various aspects of the remote airport airfield system. For example, there can be a mechanical contractor notified to correct mechanical failures, an electrical contractor which is notified to correct power failures, electronics contractors to notified to correct computer and control system failures, HVAC contractors to correct heating and cooling failures which may be associated with sustaining larger remote airport systems, etc. If no fault is detected, flow is out the "N" path of decision block 500 to a function block 504 to periodically monitor selected data points of the airport airfield system. The rate at which the data points are acquired is performed in accordance with predetermined programmed criteria. Once the data is acquired from the various measurement points, the data is stored on the airport server 108, as indicated in a function block 506. Flow is then to a decision block 508 to determined if it is time to establish communication with the control center 120 in order to upload the latest airport airfield data to the control center server 124. If not, flow is out the "N" path, and loops back to the input of decision block 500 to continue monitoring for a fault condition. Note that the fault condition may be determined in accordance with the latest set of data acquired by the airport server 108 from the data points, or the fault condition may be directly transmitted to the airport server 108 from the faulty device when the fault occurs, bypassing the periodic data acquisition step routinely executed by the server 108. Such an immediate notification system could use discrete devices distributed proximate to the data points to be measured such that a processor associated therewith continuously monitors the data wherein an alert can be transmitted as soon as any measured data point falls outside predetermined limits.

Note that it can be appreciated in cases where the data point is remotely located from the airport server 108, a standalone smart device can be utilized having a processor which is programmed to monitor the data points, and to communicate data and alerts to the airport server 108 according to prescribed time intervals, or on a realtime basis.

Referring again to decision block 508, if it is time to upload data from the airport server 108 to the control center server 124, flow is out the "Y" path to a function block 510 to establish a communication connection to the control center 120. As mentioned hereinabove, the connection can be by any number of methods, however, in this embodiment, communication is via the GCN 112. Flow is then to a decision block 512 to determine if the GCN 112 is accessible. If not, flow is out the "N" path to a function block 514 to utilize an alternative communication system as disclosed hereinabove, or in accordance with many conventional communication architectures. Flow is from function block 514 to the input of a function block 516 to upload the data to the control center server 124 by the established communication method. If the GCN 112 is accessible, flow is out the "Y" path of decision block 512 to the function block 516 to upload the data across the GCN 112 to the control center server 124.

It can be appreciated that the disclosed system also provides the capability of downloading updated programming to the remote airport server 108. For example, if an improved control and data acquisition program update had become available, the update could be downloaded from the control center server 124 to the remote airport server 108 at the time of uploading the data from the airport server 108. Alternatively, the updated program could be downloaded at times when airport traffic is determined to be the least likely to occur such that any possible programming problems would not interfere with operation of the remote airport system. Continuing with the flow chart, flow is then to a decision block 518 to determine if updated programming is available for download. If not, flow is out the "N" path, and loops back to the input of decision block 500 to continue monitoring of fault conditions. If updated programming is available for download, flow is out the "Y" path of decision block 518 to a function block 520 to commence the program transfer. Flow is to a function block 522 to then restart the program code, where necessary, and where airport airfield operation is least likely to be interrupted should a program problem occur. Flow then loops back from function block 522 to the input of decision block 500 to continue monitoring for fault conditions.

Figure 6:
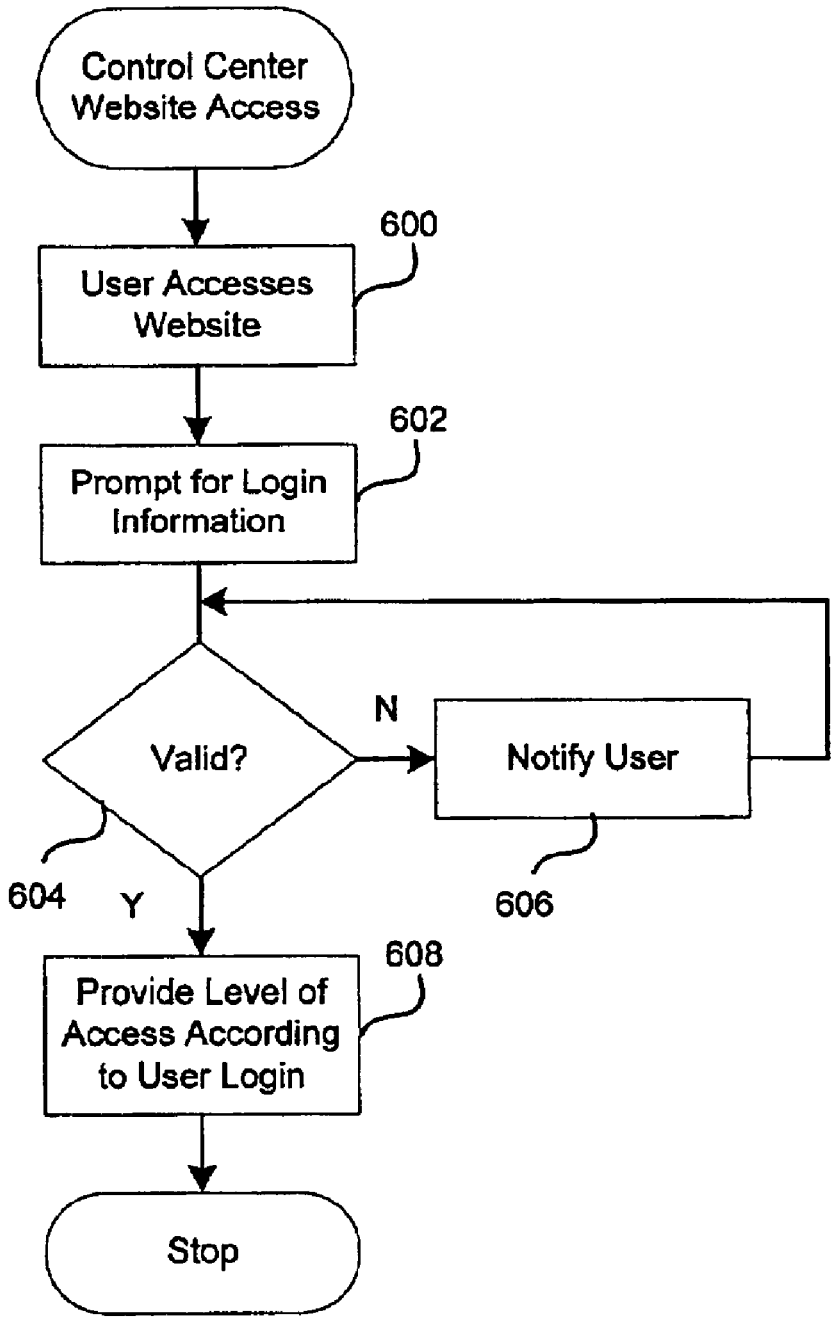
FIG. 6 illustrates a flow chart of operation from the perspective of the control center a user accesses the disclosed system.

Referring now to FIG. 6, there is illustrated a flow chart of control center system operation from the perspective of the control center when a user accesses the disclosed system. Flow begins at a function block 600 where a user establishes communication across the GCN 112 to the control center website. Note the user can be a user from the customer node 154, the maintenance contractor node 144, the sales/marketing node 138, a user from the remote airport 100, etc. Connectivity can be established from virtually any user disposed on the GCN 112 who has a network user interface device which executes a communication application (e.g., a browser) compatible for interfacing to the control center website. It is also conceivable that the data stored on the control center data server 124 is accessible using a file transfer protocol which retrieves information in a non-HTML (or browser) format. The user is then prompted for authorization information, as indicated in a function block 602. Flow is to a decision block 604 to determine if the entered authorization information is valid. If not, flow is out the "N" path to a function block 606 to notify the user that an error has occurred, and to, for example, re-enter the authorization information. Flow then loops back to the input of decision block 604 to check the entered authorization again. If multiple entry failures have occurred, the user can be locked out from further access and instructed to contact the system provider.

If the entered authorization information is valid, flow is out the "Y" path of decision block 604 to a function block 608 to perform a database query in accordance with the valid authorization information. The query establishes the association with the data which is to be presented to the authorized user, and where levels of service are provided, presents only that information to which the user is subscribed. For example, if the authorization information indicated a user at the sales node 138, the data presented to prospective customers could be that associated with a demonstration application operating on the accessed control center server 124. Alternatively, or in conjunction therewith, the sales staff can be provided access to actual data from the remote airport 100. In any case, the level of access provided to the extensive features of the disclosed airport system is provided in accordance with the authorization (or login) information. Flow then reaches a Stop block.

Figure 7:
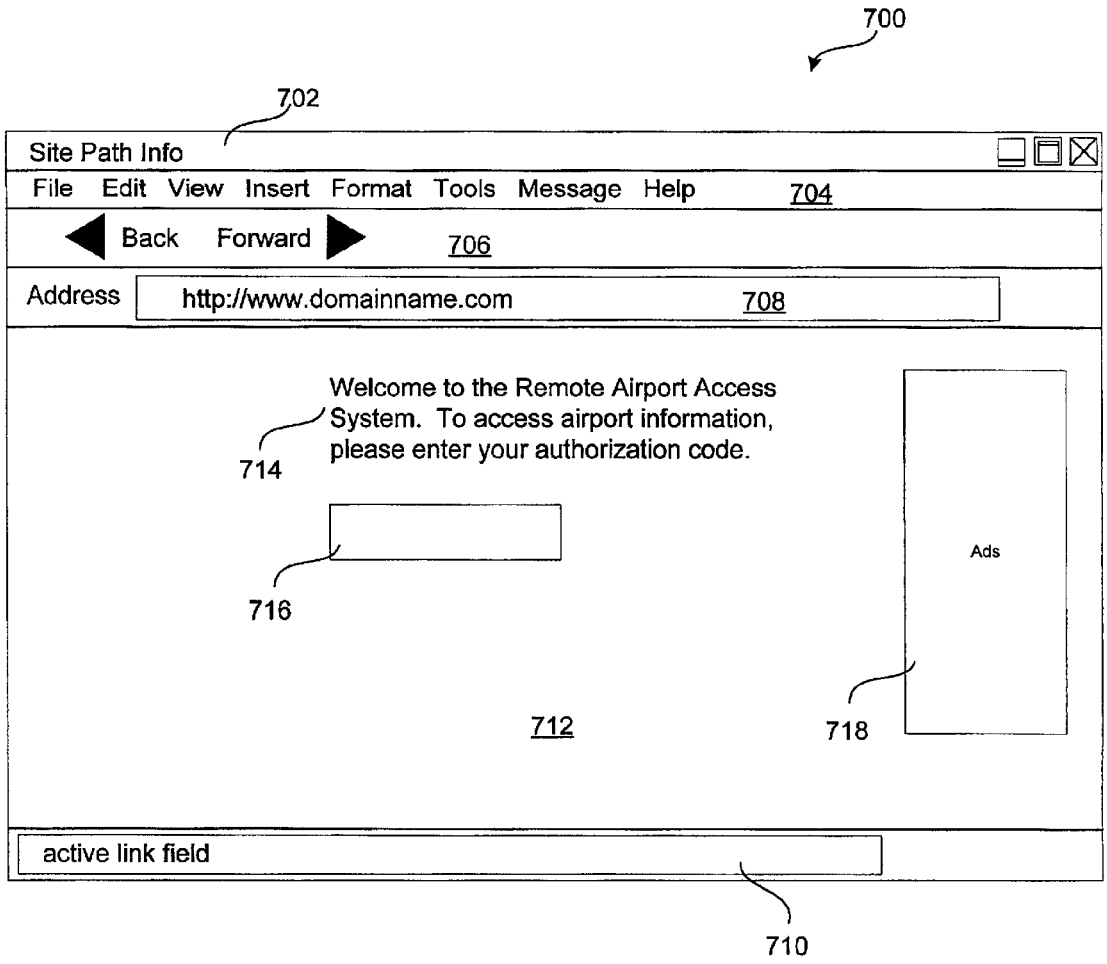
FIG. 7 illustrates a user interface of an authorization web page to the control center website.

Referring now to FIG. 7, there is illustrated a user interface of an authorization web page to the control center website. The user interface is via a conventional network communication program (e.g., a web browser). The authorization web page 700 contains standard features for providing authorized access to further information. For example, the web page contains a site path information field 702 which indicates the current Uniform Resource Locator network address of the web page 700. A menu field 704 provides various application functions which can be used by the user. A navigation bar 706 allows the user to move both forward and back through web pages which have already been downloaded from the control center data server 124 to the user computer (e.g., computer 140, 156, etc.). The web page 700 also includes an address field 708 which allows the user to enter a network address of a node on the GCN 112 to which the user may want to connect. An active link field 710 presents the network address of one or more active links embedded into the web page.

A main body area 712 of the web page 700 comprises text 714 which may, for example, provide a greeting to the user, and instruct the user to perform certain steps in order to obtain further information. In this scenario, the text 714 instruct the user to enter an authorization code in a code field 716 before further access is provided. As indicated hereinabove, the authorization code is provided to the user (e.g., the customer, contractor, sales person, etc.) when an account is opened for the customer. The authorization code is unique to each entity, but may provide access to the same information stored in a server database (e.g., the database of the control center data server 124). The authorization code may be a single alphanumeric character string, or could be a combination of a user ID and password, or any other type of conventional access authorization methods provided by network web sites.

The authorization web page 700 may also include an ad space 718 which provides fixed or rotating advertisements to the user. The ads 718 comprise information which informs the user of new updates to system, or other informational functions such as products associated with the system provider, etc. It can be appreciated that where cookies are allowed on the user computer system, whether it be the customer, contractor, sales personal, etc., the ads 718 can be customized to provide information of interest to the particular user. For example, if the user is a customer at the customer node 154 connected from California, and the remote airport is located in Minnesota, the ads 718 presented could be triggered to such geographic information to provide weather reports based upon seasonal changes, which are not a concern in California, but which may significantly impact operation of the airport airfield system in Minnesota. Similarly, where the user is a maintenance contractor, the ads 718 could be trigger in response to the contractor cookie information to present recent updates in system hardware or software which are of interest only to the contractor, or advertise recent developments in troubleshooting hardware, or airfield lighting improvements which could be purchased by the system provider.

Note that this customized advertising can also be triggered based upon the unique user authorization code, such that the information is provided on a subsequent web page, and in greater detail according to specific user interests and the remote airport(s) being monitored. The extent of the messaging via the advertisement area 718 can accommodate a wide variety of information including paid advertising for related products.

Figure 8:
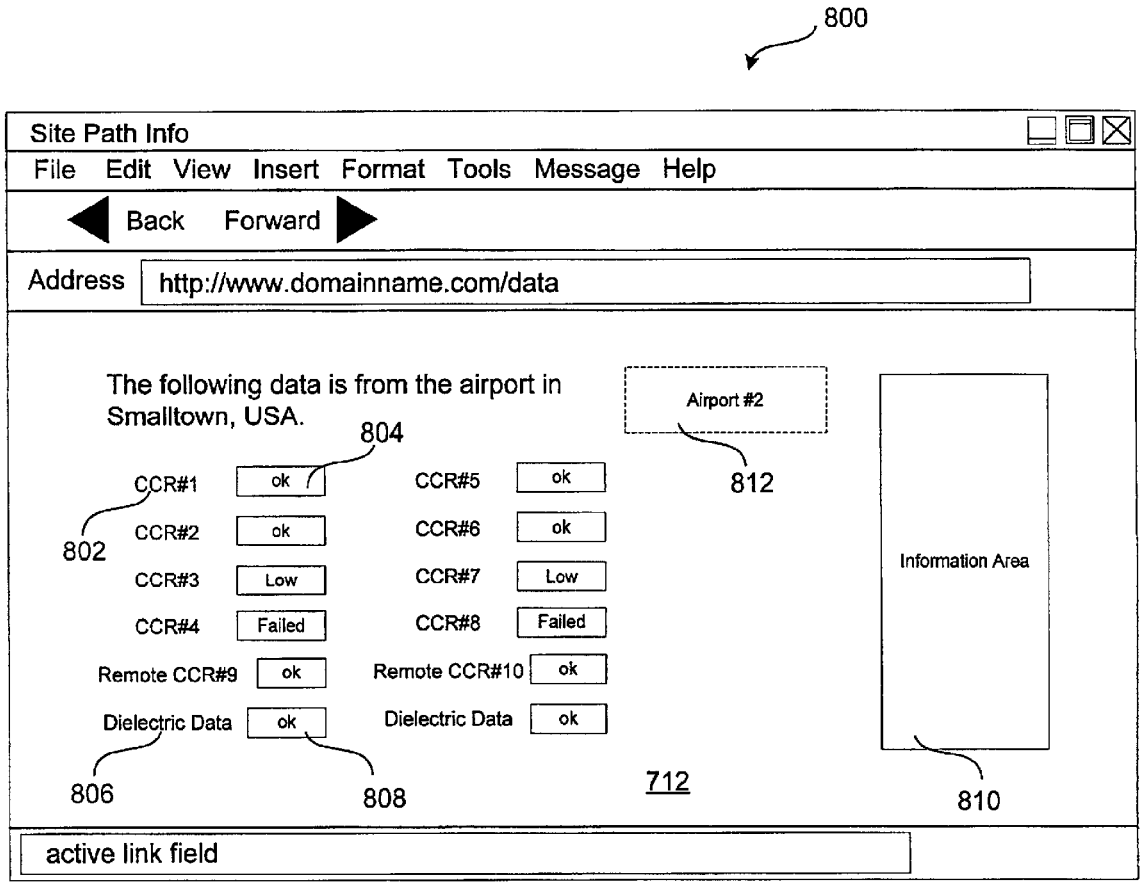
FIG. 8 illustrates a follow-up web page to the authorization web page showing various data parameters which can be accessed by a user.

Referring now to FIG. 8, there is illustrated a follow-up data web page 800 to the authorization web page 700 showing various data parameters which can be accessed by a user. The primary difference between the information of this web page and the previous authorization web page 700 is contained within the body area 712. After the user authorization code has been validated, the data web page 800 is presented to the user with various data parameter information about the status of the remote airport airfield system selected. If the remote airport airfield system had ten CCR front-end systems for monitor and control of airfield lighting, data regarding each CCR could be listed on the data web page 800 along with an associated status field. For example, a first CCR 802 is listed, and has associated therewith a data field 804 in which a corresponding data parameter can be placed in a numerical format to indicate the state of that light system. Alternatively, the data can be automatically interpreted by software such that a general status text (e.g., "ok" or "failed") is provided, when the particular CCR 106 is operating properly. Other data can also be provided, for example, measured parameters related to dielectric integrity 806 of the series system are retrieved from the control center data server 124 and inserted into a corresponding dielectric field 808 for presentation to the user. Additionally, an information area 810 can be provided for presenting detailed information to the user. Since the user has already passed the authorization stage, information provided in the information area 810 can be sufficiently detailed, e.g., to inform the user regarding account information, hardware/software historical data, etc. It can be appreciated that the information provided herein is solely at the discretion of the system provided and the user.

In an alternative embodiment, the type of information provided can be based upon the authorized user. For example, if the user is a sales person, the level of detail provided in the data fields 804 may be in a go/no-go format, e.g., "ok" or "failed, whereas if the user was a repair technician, the data would be actual numerical values which are more useful in determining the true state of the remote airport system. It can be appreciated that numerous options can be provided to the specific users of the web portal based upon a number of factors, and the availability of the options can be based upon a subscribed level of service, or each user can have full access, etc.

Where the customer has several remote airports 122 under monitor and control utilizing the disclosed system, the web page 800 can include data for both airports on the same web page 800 if sufficient web page real estate exists, or an active link 812 can be provided, which when selected by the user, presents another web page (not shown) of data and information associated with that remote airport 122.

Referring now to FIG. 9, there is illustrated a database structure 900 of account information and data parameters which may be archived, in accordance with a disclosed embodiment. As indicated hereinabove, numerous pieces of information may be stored in association with a user in the database of the control center data server 124 for later retrieval and presentation. For example, in this particular database example, an authorization code field 902 provides a primary association with the remote airport 100 by linking the authorization code with data of the particular remote airport 100. When the user enters an authorization code, a variety of associated information is made available for presentation to the user. This associated information is also accessed when a fault condition is detected, such that when an airport code 903 is known, the corresponding contact information for the repair technician (and/or other designated persons) can be retrieved for establishing communication thereto. As illustrated, the contact information comprises an e-mail field 904, a pager field 906, and telephone number field 908. Other contact information can also be provided, as mentioned hereinabove, for example, a facsimile number, a cellular telephone number, a network address to a PDA device, etc.

The database 900 also includes a service level field 910 which defines the level of subscribed service, where such an option is provided. For example, a first customer 912 (Cust1) may have subscribed to a level of service (e.g., level 1) which includes presenting status data parameters 911 of a general nature (e.g., "ok") with respect to a corresponding remote airport airfield system, and does not present, for example, trending information which is provided at a different level (albeit more costly) of service (e.g., level 4), specific parameter values, etc. Many different options for data manipulation can be provided limited only by the robustness of the underlying applications which process the data and support the control center web site. It can be appreciated that the information presented to the a repair technician (Repair1) associated with a repair field 914 can be more specific to facilitate problem resolution. Note that a single customer (Cust1) may have the same authorization code for accessing multiple remote airports (e.g., aaaa and xxxx) for which service is subscribed.

The database associated with the data server 124 can also store maintenance and parts information such that as the maintenance technician orders and uses parts or components from inventory, the part can be tracked as to the location at which it is used. The maintenance database can also operable to track the inventory to automatically trigger replenishment by notifying an individual to order sufficient parts to bring inventory of those parts or components back to a minimum level. The data server is also operable to automatically notify, for example, a central inventory warehouse to ship a replacement part when the cause of a fault is detected by the disclosed system. The data server 124 can also cross-check the availability of the failed component against an inventory database of parts or components stored locally to the airport to first determine if the part can be obtained from a local inventory or needs to be ordered-in from a remote location.

Although the preferred embodiment has been described in detail, it should be understood that various changes, substitutions and alterations can be made therein without departing from the spirit and scope of the invention as defined by the appended claims.

What is claimed is:

1. A system of operating an airfield lighting system of an airport, comprising:

a primary processing system local to the airport and in communication with the airfield approach lighting system for at least one of monitor and control thereof, said airfield approach lighting system producing airfield approach lighting status information for processing by said primary processing system;

a global communication packet switched network connected to the primary processing system;

a redundant secondary processing system in communication with the airfield approach lighting system for at least one of monitor and control thereof, wherein the redundant secondary processing system accesses said primary processing system from a remote location disposed on the global communication packet-switched network such that said airfield approach lighting status information is accessed from the remote location; and redundant wired and wireless communication systems coupling the primary processing system to the redundant secondary processing system when the global communication packet switched network fails.

2. The system of claim 1, wherein said airfield approach lighting status information is accessed by a user at a user node at said remote location.

3. The system of claim 2, wherein said user node provides access to said airfield approach lighting status information via a web site.

4. The system of claim 3, wherein said web site presents said airfield approach lighting status information to said user at said remote location in response to said user first providing a valid authorization code.

5. The system of claim 2, wherein said user is a sales/marketing person at said remote location, which said remote location is a sales/marketing node disposed on said global communication network.

6. The system of claim 2, wherein said user is a customer of said remote location, which said remote location is a customer node disposed on said global communication network.

7. The system of claim 2, wherein said user is a maintenance repair person of said remote location, which said remote location is a contractor node disposed on said global communication network.

8. The system of claim 1, wherein said airfield approach lighting status information is accessed directly from a user node at said remote location which is disposed on said global communication network.

9. The system of claim 1, wherein said global communication packet-switched network is the Internet.

10. The system of claim 1, wherein a user is notified with a notification message which is automatically transmitted in response to a fault condition detected in the airfield lighting system.

11. The system of claim 10, wherein said notification message is transmitted via electronic mail to said user.

12. The system of claim 10, wherein said notification message is transmitted via cellular telephone to said user.

13. The system of claim 10, wherein said notification message transmitted via a wireless pager to said user.

14. The system of claim 10, wherein said notification message is transmitted from a central control center disposed on said global communication network which uploads said airfield approach lighting status information from said local processing system via said global communication network on a periodic basis and processes said uploaded airfield approach lighting status information to determine if a fault condition has occurred in the airfield lighting system of the airport.

15. The system of claim 1, further comprising:

a second airfield approach lighting system at a second airport; and a second primary processing system local to the second airport and in communication with the second airfield approach lighting system for monitor and control thereof, said second airfield approach lighting system producing second airfield approach lighting status information for processing by said second primary processing system;

wherein the redundant secondary processing system is in communication with the second airfield approach lighting system for monitor and control thereof, the redundant secondary processing system accesses said second primary processing system from the remote location disposed on the global communication packet-switched network to obtain the second airfield approach lighting status information.

16. A method of monitoring an airfield system of an airport, comprising:

locally monitoring the airfield system with a primary processing system local to the airport, said airfield system producing airfield system information for processing by said primary processing system;

accessing the airfield system information from a central control center at a remote location, the central control center comprising a redundant secondary processing system for monitoring of the airfield system, wherein the redundant secondary processing system is connected to the airfield system by a global communication network; and accessing the airfield system information from the central control center via redundant wired and wireless communication systems when the global communication network fails.

17. The method of claim 16, further comprising accessing the control center from a second remote location which is disposed on said global communication, network.

18. The method of claim 17, wherein the central control center provides access to said airfield system information via a web site.

19. The method of claim 18, further comprising:

sending a control command to the airfield system from the second remote location to the central control center;

wherein the central control center being responsive to the control command to communicate the control command to the airfield system.

20. The method of claim 19, wherein said global communication network is the internet.

21. The method of claim 16, wherein the airfield system comprises an airfield approach lighting system.

22. The method of claim 21, further comprising:

locally controlling a second airfield system at a second airport; by a second primary processing system local to the second airport and in communication with the second airfield approach lighting system for monitor and control thereof, said second airfield approach lighting system producing second airfield approach lighting status information for processing by said second primary processing system; and accessing the second airfield approach lighting system information by the redundant secondary processing system remotely located from the second airport and disposed on the global communication packet-switched network for monitor and control of the second airfield approach lighting system.

23. The method of claim 22, further comprising:

controlling the airfield lighting system and the airfield approach lighting system from the redundant secondary processing system by sending commands on a redundant communication link connecting the primary processing system and the second primary processing system to the secondary processing system.

24. The system of claim 23, wherein the redundant communication link is at least one of a packet switched telephone network and a wireless network.

25. A system, comprising:

a first airfield lighting system located at a first airport;

a second airfield lighting system located at a second airport;

means for controlling the first airfield lighting system coupled to the first airfield lighting system and located at the first airport;

means for controlling the second airfield lighting system coupled to the second airfield lighting system and located at the second airport;

a redundant control means for controlling the first airfield lighting system and the second airfield lighting system located at a remote location from the first airport and the second airport;

a global communication means for coupling the means for controlling the first airfield lighting system, the means for controlling the second airfield lighting system, and the redundant control means;

a redundant wired communication means for coupling the means for controlling the first airfield lighting system, the means for controlling the second airfield lighting system, and the redundant control means when the global communications means fails; and a redundant wireless communication means for coupling the means for controlling the first airfield lighting system, the means for controlling the second airfield lighting system, and the redundant control means when the global communication means fails.

26. The system of claim 25, further comprising:

at least one additional airport lighting system located at an at least one additional airport;

at least one additional means for controlling the at least one additional airport lighting system at a location corresponding to the at least one additional airport;

wherein the global communication means for coupling the means for controlling the first airfield lighting system, the means for controlling the second airfield lighting system, and the redundant control means further comprises a connection to the at least one additional means for controlling the at least one additional airport;

wherein the redundant wired communication means for coupling the means for controlling the first airfield lighting system, the means for controlling the second airfield lighting system, and the redundant control means when the global communications means fails further comprises a connection to the at least one additional means for controlling the at least one additional airport;

wherein the redundant wireless communication means for coupling the means for controlling the first airfield lighting system, the means for controlling the second airfield lighting system, and the redundant control moans when the global communications means fails further comprises a connection to the at least one additional means for controlling the at least one additional airport; and wherein the redundant control means is remotely located from the at least one additional airport and further comprises means for controlling the at least one additional airport lighting system.

27. The system of claim 25, further comprising a plurality of airfield lighting systems located at a plurality of corresponding airports;

a plurality of means for controlling the airfield lighting systems located at the plurality of corresponding airports;

wherein the global communication means for coupling the means for controlling the first airfield lighting system, the means for controlling the second airfield lighting system, and the redundant control means further comprises a connection to the plurality of means for controlling the airfield lighting systems located at the plurality of corresponding airports;

wherein the redundant wired communication means for coupling the means for controlling the first airfield lighting system, the means for controlling the second airfield lighting system, and the redundant control means when the global communications means fails further comprises a connection to the plurality of means for controlling the airfield lighting systems located at the plurality of corresponding airports;

wherein the redundant wireless communication means for coupling the means for controlling the first airfield lighting system, the means for controlling the second airfield lighting system, and the redundant control means when the global communications means fails further comprises a connection to the plurality of means for controlling the airfield lighting systems located at the plurality of corresponding airports; and wherein the redundant control means is remotely located from the plurality of corresponding airports and further comprises means for controlling the at plurality of airfield lighting systems located at the plurality of corresponding airports.

28. A system of operating an airfield lighting system of an airport according to claim 1, wherein the redundant communication system is at least one of a wired and a wireless communication system.

29. A system of operating an airfield lighting system of an airport according to claim 1, the redundant communication system further comprising:

a redundant wired communication means for coupling the primary processing system and the redundant secondary processing system; and a redundant wireless communication means for coupling the primary processing system and the redundant secondary processing system.

30. A method of monitoring an airfield system of an airport according to claim 16, wherein the redundant communication system is at least one of a wired and a wireless communication system.

31. A method of monitoring an airfield system of an airport according to claim 16, the redundant communication system further comprising:

a redundant wired communication means for coupling the primary processing system and the central control center; and a redundant wireless communication means for coupling the primary processing system and the central control center.

* * * * *